US007950191B2

(12) United States Patent
Brouwers

(10) Patent No.: US 7,950,191 B2
(45) Date of Patent: May 31, 2011

(54) CONTINUOUS FLEXIBLE SUPPORT STRUCTURE ASSEMBLY

(75) Inventor: Henricus Brouwers, Blanden (BE)

(73) Assignee: Conwed Plastics LLC, Minneapolis, MN (US)

( * ) Notice: Subject to any disclaimer, the term of this patent is extended or adjusted under 35 U.S.C. 154(b) by 56 days.

(21) Appl. No.: 12/264,425

(22) Filed: Nov. 4, 2008

(65) Prior Publication Data

US 2010/0109189 A1 May 6, 2010

(51) Int. Cl.
*E04F 11/16* (2006.01)

(52) U.S. Cl. ..... 52/180; 52/177; 52/581; 404/34; 404/36; 404/37; 404/41; 404/42; 15/161; 15/238

(58) Field of Classification Search ..... 15/161, 15/215, 216, 217, 238, 239, 240, 241; 52/177, 52/180, 578, 581, 591.1, 592.1, 388, 663; 404/34, 36–38, 40, 41; 47/1.01 F, 1.01 R
See application file for complete search history.

(56) References Cited

U.S. PATENT DOCUMENTS

| | | | | |
|---|---|---|---|---|
| 1,722,139 | A * | 7/1929 | Pasquale | 404/19 |
| 3,310,906 | A * | 3/1967 | Glukes | 446/95 |
| 3,960,375 | A | 6/1976 | Bibi-Roubi et al. | |
| 4,067,197 | A | 1/1978 | Ritter | |
| 4,111,585 | A * | 9/1978 | Mascaro | 404/70 |
| 4,152,875 | A * | 5/1979 | Soland | 52/223.7 |
| 4,372,705 | A | 2/1983 | Atkinson | |
| 4,440,818 | A * | 4/1984 | Buchan et al. | 428/99 |
| 4,584,221 | A * | 4/1986 | Kung | 428/44 |
| 4,671,699 | A | 6/1987 | Roach | |
| 5,250,340 | A * | 10/1993 | Bohnhoff | 428/99 |
| 5,406,745 | A * | 4/1995 | Lin | 47/1.01 F |
| 5,509,244 | A * | 4/1996 | Bentzon | 52/387 |
| 5,713,155 | A | 2/1998 | Prestele | |
| 5,713,175 | A * | 2/1998 | Mitchell | 52/582.1 |
| 5,787,654 | A * | 8/1998 | Drost | 52/177 |
| 5,950,378 | A * | 9/1999 | Council et al. | 52/177 |
| D423,123 | S | 4/2000 | Sassenberg | |
| D442,704 | S * | 5/2001 | Lee | D25/118 |
| 6,451,400 | B1 * | 9/2002 | Brock et al. | 428/44 |
| 6,526,710 | B1 * | 3/2003 | Killen | 52/220.1 |

(Continued)

FOREIGN PATENT DOCUMENTS

JP 2005-199439 A 7/2005

(Continued)

OTHER PUBLICATIONS

Patent Cooperation Treaty Search Report dated Aug. 17, 2010. Applicant Conwed Plastics LLC, Application No. PCT/US2009/065137. 9 pages.

*Primary Examiner* — Brian E Glessner
*Assistant Examiner* — Babajide Demuren
(74) *Attorney, Agent, or Firm* — Brooks Kushman P.C.

(57) ABSTRACT

A surface support structure is provided with at least one cell having a plurality of upright walls. A first wall of the plurality of upright walls has a recessed portion forming at least a portion to allow extension and contraction in multiple directions of the at least one cell. The plurality of upright walls of the at least one cell define a perimeter such that the recessed portion extends towards a second wall of the plurality of upright walls and is within the perimeter.

12 Claims, 6 Drawing Sheets

U.S. PATENT DOCUMENTS

| | | | | |
|---|---|---|---|---|
| 6,622,440 | B2 * | 9/2003 | Mercade | 52/177 |
| 7,201,538 | B2 * | 4/2007 | Blackwood et al. | 405/50 |
| 7,210,876 | B2 | 5/2007 | Moralez et al. | |
| 7,300,224 | B2 | 11/2007 | Slater | |
| D571,024 | S | 6/2008 | Lee | |
| 2002/0122912 | A1 | 9/2002 | Brock et al. | |
| 2006/0275082 | A1 * | 12/2006 | Blackwood | 405/36 |
| 2008/0131202 | A1 | 6/2008 | Slater | |
| 2008/0276557 | A1 * | 11/2008 | Rapaz | 52/302.3 |

FOREIGN PATENT DOCUMENTS

| | | | |
|---|---|---|---|
| KR | 10-2008-0079448 | A | 9/2008 |

* cited by examiner

CONTINUOUS FLEXIBLE SUPPORT STRUCTURE ASSEMBLY

BACKGROUND

1. Technical Field

Multiple embodiments relate to a continuous flexible support structure assembly for use on and within various surfaces.

2. Background Art

Various surfaces are often utilized as ground, walking or roofing surfaces, such as turf grass, soil and/or gravel. Such materials are often subject to migration and/or erosion. Additionally, in areas of high pedestrian and/or vehicle traffic, surface stabilization, traction support and/or load weight support may be necessary to alleviate compaction and wear damage to the ground surface. Furthermore, adequate drainage is required for the various surfaces so that precipitation and other liquids do not stand on the various surfaces.

SUMMARY

In one embodiment, a surface support structure is provided with at least one cell having a plurality of upright walls. A first wall of the plurality of upright walls has a recessed portion forming at least a portion to allow extension and contraction in multiple directions of the at least one cell. The plurality of upright walls of the at least one cell define a perimeter such that the recessed portion extends towards a second wall of the plurality of upright walls and is within the perimeter.

In another embodiment, a method of manufacturing is disclosed. A first surface support structure is molded with a first plurality of cells formed therein. The first plurality of cells each have a first plurality of upright walls. A first wall of the first plurality of upright walls has a recessed portion to allow extension and contraction in multiple directions of the first plurality of cells. A second surface support structure is molded with a second plurality of cells formed therein. The second plurality of cells each have a second plurality of upright walls. A first wall of the second plurality of upright walls has a recessed portion to allow extension and contraction in multiple directions of the second plurality of cells. The first surface support structure is joined to the second surface support structure.

In yet another embodiment, a surface support structure assembly is provided. A first surface support structure has at least one cell having a first plurality of upright walls. A first wall of the first plurality of upright walls has a recessed portion to allow extension and contraction in multiple directions of the at least one cell. A second surface support structure has at least one cell with a second plurality of upright walls. A first wall of the second plurality of upright walls has a recessed portion to allow extension and contraction in multiple directions of the at least one cell. The first surface support structure and the second surface support structure are joined together.

DETAILED DESCRIPTION OF EMBODIMENTS

Figure 1:
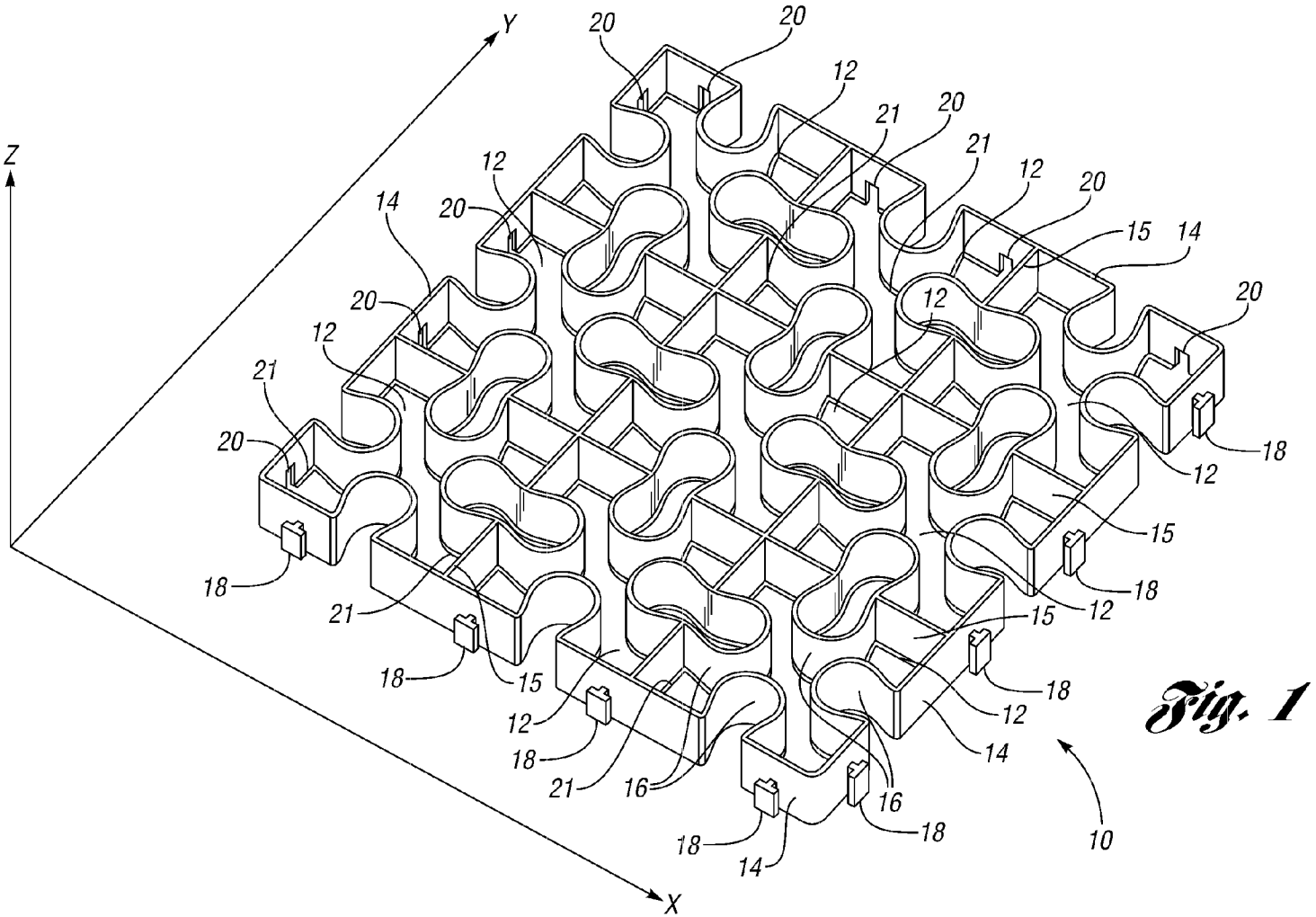
FIG. 1 is a perspective view of a surface support structure made in accordance with an embodiment of the present invention.

As required, detailed embodiments are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the disclosed embodiments.

Moreover, except where otherwise expressly indicated, all numerical quantities in the description are to be enlisted as modified by the word "about" in describing the broader scope of the invention. Practice within the numerical limit stated is generally preferred. Also, unless expressly stated to the contrary, the description of a group or class of materials is suitable or preferred for a given purpose in connection with the invention implies that mixtures of any two or more members of this group or class may be equally suitable or preferred.

Referring to FIGS. 1-6, examples of surface support structures are illustrated and generally referenced by numeral 10. The surface support structure 10 can be employed on and/or within various surfaces to serve as a reinforcing paver with fully integrated flexibility to follow accurately ground topography and offering easy installation performance. The various surfaces include but are not limited to outdoor ground surfaces and roof or indoor surfaces having turf grass, soil, dirt and/or gravel. Of course, the surface support structure 10 can be implemented on and/or within any desired surface.

In at least one embodiment, as discussed further below, multiple surface support structures 10 are employed on and/or within the ground surface. By the term "within", it should be understood to encompass partially within such that a portion of the surface support structure 10 is under the ground while another portion is above (or visible on) the ground surface, and totally within such that the entire surface support structure 10 is below the ground surface.

The surface support structure 10 can inhibit migration and/or erosion of the ground surface, and provide traction support and/or load weight support of the ground surface. Additionally, the open configuration of the surface support structure 10, which is discussed further below, allows for proper storm precipitation management so that precipitation can drain through the surface support structure 10 to inhibit the ground surface flooding. The surface support structure 10 can move in any direction along the x-axis X, the y-axis Y, and/or the z-axis Z to fit on and/or within different topographies of various ground surfaces. In one embodiment, the surface support structure 10 is installed on top of an existing a ground surface, such as turf grass, so that the turf grass can grow around the surface support structure 10. In another embodiment, the surface support structure 10 is installed within a ground surface, such as gravel, so that the gravel is under and/or within the surface support structure 10 and the surface support structure 10 supports the ground surface. In yet another embodiment, the surface support structure 10 is filled with soil and fertilizer to allow grass to grow over the surface support structure 10. Of course, the surface support structure 10 can be utilized on any desired surface in a multitude of ways.

Figure 5:
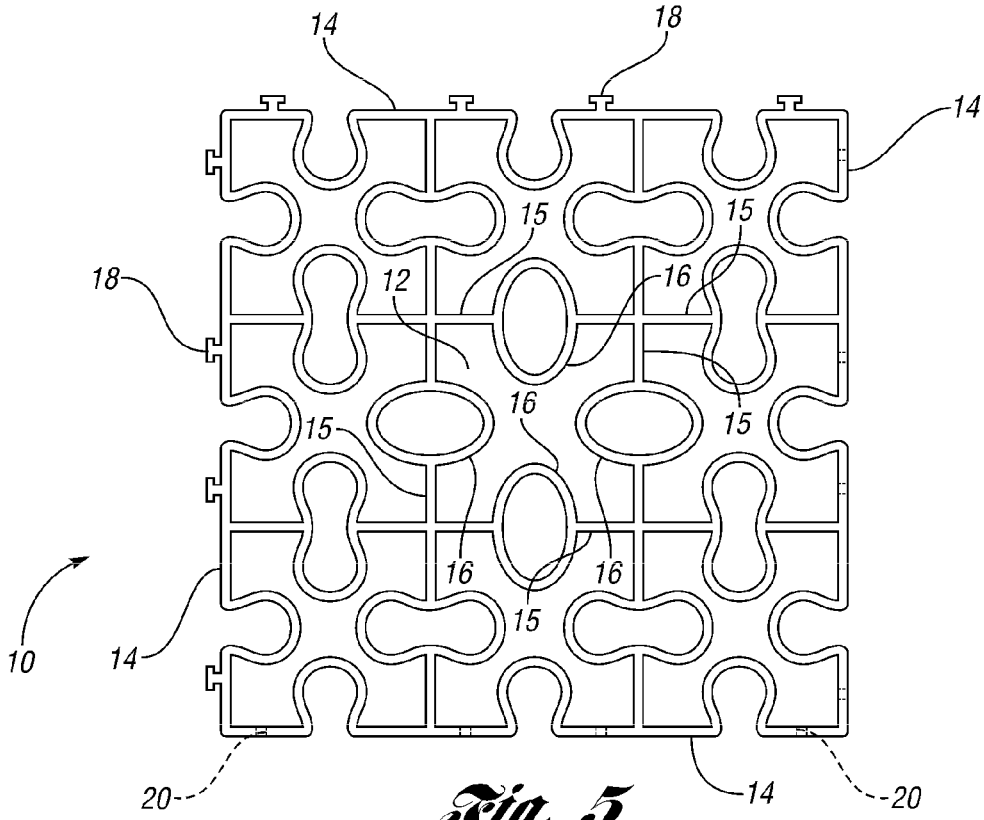
FIG. 5 is a plan view of yet another embodiment of the surface support structure of FIG. 1.
Figure 6:
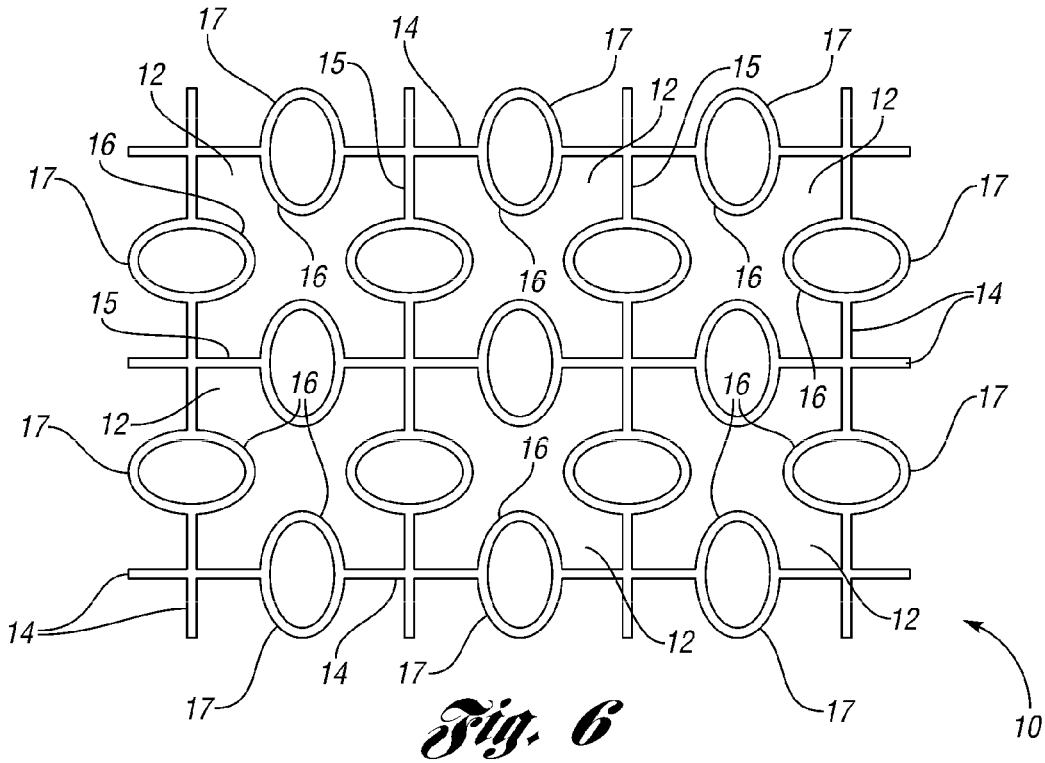
FIG. 6 is a plan view of still another embodiment of the surface support structure of FIG. 1.

As illustrated, the surface support structure 10 is integrally formed into multiple cells 12. As with the example surface support structures 10 illustrated in FIGS. 1-5, nine integrally formed cells 12 may be injection molded in a single shot molding process of the surface support structure 10. As illustrated in FIG. 6, six integrally formed cells 12 may be formed as one surface support structure 10. However, it should be understood that the number of cells 12 can vary as desired. In at least the illustrated embodiment, the cells 12 may be oriented along the x-axis X and the y-axis Y as illustrated in FIG. 1, and may form a square having an equal amount of cells 12 displaced along the x-axis X and the y-axis Y. In at least one embodiment, the surface support structure 10 has a size of approximately fifty centimeters by fifty centimeters. In other embodiments, the surface support structure 10 can have various lengths (along the x-axis X) and/or widths (along the y-axis Y) as desired. In one embodiment, the surface support structure 10 has a length of ten to one hundred and fifty centimeters and/or a width of ten to one hundred and fifty centimeters. In one embodiment, the surface support structure 10 has a length and/or a width of forty to one hundred centimeters. Of course, any suitable amount, orientation and size of the cells 12 and/or surface support structure 10 are contemplated within the scope of the disclosed embodiments.

In at least one embodiment, the cells 12 of the surface support structure 10 are integrally formed out of a plastic material, such as a polyethylene. Polyethylene is a suitable material for the cells 12 of the surface support structure 10 as it is a relatively strong material that retains shape while being elastic to allow for some movement of each cell 12 of the surface support structure 10. Although a flexible material may be employed to form the cells 12 of the support structure 10, the configuration of the cells 12 of the surface support structure 10, discussed below, allow the surface support structure 10 to move. Of course, other recycled plastics, non-recycled plastics, polymers and/or additives can be employed to form each cell 12 of the surface support structure 10 depending on the mechanical properties desired.

In at least one depicted embodiment, the cells 12 have four integrally formed upright walls 14, 15. The upright walls 14, 15 provide traction support and/or load weight support in the ground surface that the surface support structure 10 is installed on or within. Although four upright walls 14, 15 are illustrated for each cell 12, any suitable amount of upright walls 14, 15 is contemplated within the scope of the disclosed embodiments. Moreover, it should be understood that the upright walls 14, 15 could also have small spaces therebetween such that they are not totally integral. The cells 12 may have outer upright walls 14 and/or inner upright walls 15. The outer upright walls 14 may be similar and/or the same as the inner upright walls 15, while having different locations. The upright walls 14, 15 of each cell 12 may be continuous with upright walls 14, 15 of adjacent cells 12 so that repetition materials and increased thickness for the upright walls 14, 15 is not required. The upright walls 14, 15 may have any desired thickness. Since the upright walls 14, 15 of each cell may be integrally formed with upright walls 14, 15 of adjacent cells, material costs are reduced.

In one embodiment, the upright walls 14, 15 may have a heights of two and a half centimeters. In another embodiment, the upright walls 14, 15 may have a heights of five centimeters. In yet another embodiment, the upright walls 14, 15 have a height of seven centimeters. In still another embodiment, the upright walls 14, 15 have a height of one centimeter. Of course, any suitable height for the upright walls 14, 15 is contemplated within the scope of the disclosed embodiments.

Figure 2:
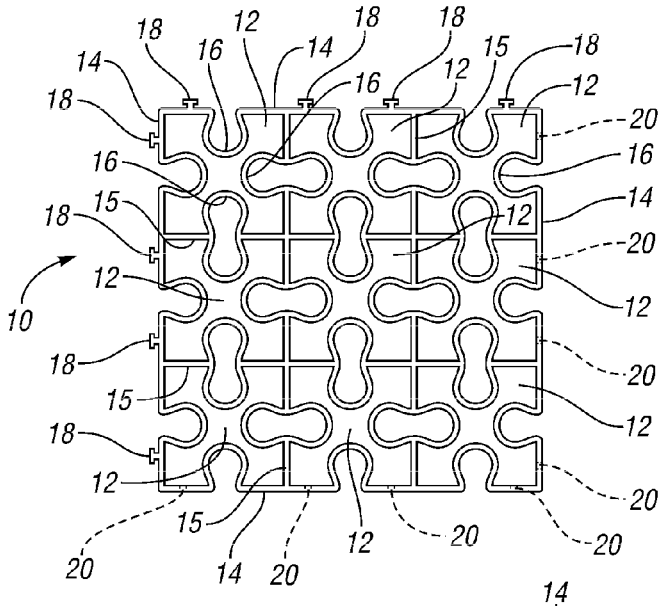
FIG. 2 is a plan view of the surface support structure of FIG. 1.
Figure 3:
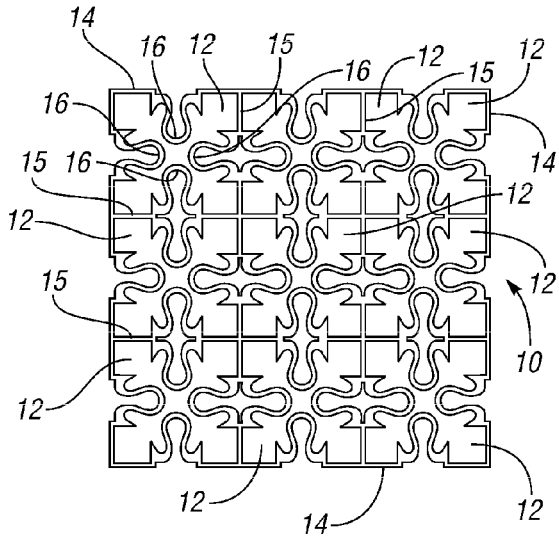
FIG. 3 is a plan view of another embodiment of the surface support structure of FIG. 1.
Figure 4:
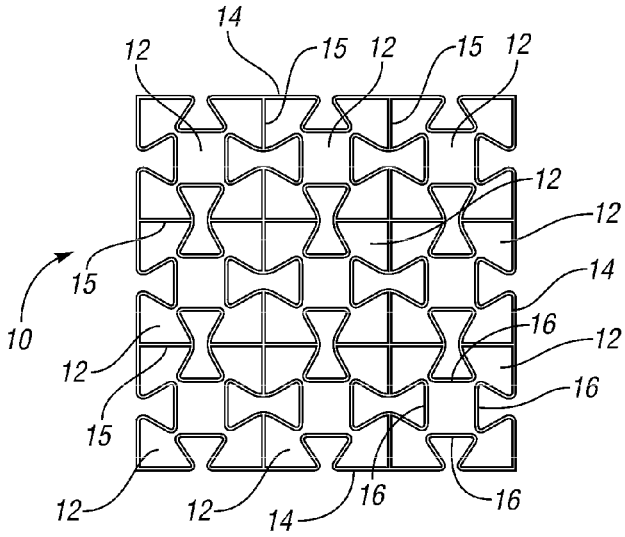
FIG. 4 is a plan view of yet another embodiment of the surface support structure of FIG. 1.

In at least the illustrated embodiments, within each upright wall 14, 15 includes a recessed portion 16 defining a recess therein. The recessed portions 16 forms a portion of each upright wall 14, 15 to allow movement in along the x-axis X, the y-axis Y and the z-axis Z, which allows each cell 12 to be flexible. Although each upright wall 14, 15 is illustrated with a recessed portion 16, recessed portions 16 may not be formed within each upright wall 14, 15. Any amount of recessed portions 16 may be formed in each cell 12 so that each cell 12 has at least one recessed portion 16. As illustrated in FIGS. 1-3, the recessed portion 16 of each cell 12 may have an arcuate shape, which allows movement of the cell 12. As illustrated in FIG. 3, the arcuate shape of the recessed portions 16 of each cell 12 may have an omega shape to allow movement of the cell 12. As illustrated in FIG. 4, the recessed portions 16 of each cell 12 may have partial polygonal shape, allowing movement of the cell 12. In at least one embodiment, the recessed portions 16 have a partial triangular shape to allow movement of the cell 12. In at least one embodiment, the recessed portions 16 are provided in the corners of the upright walls 14, 15.

The recessed portions 16 may have a thickness of less than a quarter of a centimeter to over five centimeters. Of course, the recessed portions 16 may have any desired thickness and may be the same as the thickness of the upright walls 14, 15 or may be different. As depicted in FIG. 5, the recessed portions 16 may have various shapes within the surface support structure 10. Of course, any suitable shape, orientation and/or thickness for the recessed portions 16 that allow for movement of the cell 12 is contemplated within the scope of the disclosed embodiments.

As illustrated in FIG. 6, each upright wall 14 may have multiple recessed portions 16, 17. A first recessed portion 16 may extend towards another upright wall 14, 15 of the cell 12. A second recessed portion 17 may extend in an opposite direction to that of the first recessed portion 16. Of course, any suitable recessed portion 16 and/or 17 is contemplated within the scope of the disclosed embodiments.

In at least one embodiment, the upright walls 14, 15 and/or the recessed portions 16 have a texture formed thereon. The texture may be indentations, bumps, and/or wrinkles that are formed within sides and/or tops of the upright walls 14, 15 and/or the recessed portions 16 to increase a coefficient of friction for each upright wall 14, 15 and recessed portion 16.

The increased coefficient of friction may provide better traction for pedestrians, animals, and/or vehicles when on the surface support structure 10.

In prior art surface support structures, flexible elements connect fully rigid components to form the surface support structures so that portions of the surface support structure are rigid and portions are flexible. The prior art surface support structures have flexible portions that are concentrated together and rigid portions that are concentrated together. On the other hand, each cell 12 of the surface support structure 10 described herein integrates rigid elements, upright walls 14, 15, and flexible elements, recessed portions 16, into a single design to create a continuous flexible surface support structure 10 capable of fully undulating. A continuous flexible surface support structure 10 is moveable within each cell 12 at each recessed portion 16 along the x-axis X, the y-axis Y, and the z-axis Z, as depicted in FIG. 1.

The surface support structure 10 can be laid out on the ground surface following natural topography of the ground surface because each recessed portion 16 of each cell 12 can move along the x-axis X, the y-axis Y, and the z-axis Z. Installation is improved because the ground surface does not need to be completely flattened and the surface support structures 10 can be extended and/or contracted to fit the natural topography of the ground surface. Also, when installing the surface support structures 10 on surfaces having boundaries that may be non-straight, the surface support structures 10 can expand and/or contract to fit as necessary. Thus, cutting of the surface support structures 10 is not required, saving time and money. After installation, the surface support structure 10 will further accommodate any underlying ground movement and/or settling to improve durability of the surface support structures 10 and to avoid damages caused by loads applied on spots where voids could have been formed under the surface support structure 10. Additionally, the surface support structure 10 is continuously flexible since the surface support structure 10 has upright walls 14, 15 with a small thickness and including recessed portions 16, so that the surface support structure 10 can move along the x-axis X, the y-axis y, and the z-axis z.

As illustrated in FIGS. 1-2, the surface support structure 10 may have fasteners 18 that are integrally formed on outer upright walls 14 of various cells 12. The fasteners 18 can be provided to join the surface support structure 10 to another surface support structure, as is discussed further below. Additionally, the surface support structure 10 may have apertures 20 provided in outer upright walls 14 of various cells 12. In at least one embodiment, the apertures 20 are sized to receive the fasteners 18 so that fasteners 18 provided on adjacent surface support structures 10 can be inserted into and retained within the apertures 20. In at least one embodiment, the fasteners 18 may be formed with flanges that can be inserted into the apertures 20 and once inserted into the apertures 20 are retained within the apertures. Of course any suitable fasteners 18 and/or apertures 20 to join the surface support structure 10 to another surface support structure 10 are contemplated within the scope of the disclosed embodiments. Additionally, the fasteners 18 and apertures 20 may have any suitable position on the outer upright walls 14. In one non-limiting example, fasteners 18 and apertures 20 are provided along the same outer upright wall 14. In at least one embodiment, the fasteners 18 are integrally molded within the surface support structure 10.

As illustrated in FIG. 1, each upright wall 14, 15 and each recessed portion 16 may have a protruding edge 21 provided proximate a lower edge of each cell 12. The protruding edge 21 is a base for the surface support structure 10 so that when installed within a surface, the surface support structure 10 does not sink into the surface. In another embodiment, each upright wall 14, 15 and each recessed portion 16 has a thickness that is greater proximate the lower edge of each cell 12 than proximate an upper edge of each cell 12 to increase stability of the surface support structure 10. In one embodiment, the thickness may be twenty-five percent larger at the lower edge of each cell 12 than at the upper edge of each cell 12. In another embodiment, the thickness may be fifty percent larger at the lower edge of each cell 12 than at the upper edge of each cell 12. Of course, any change in thickness between the lower edge of each cell 12 and the upper edge of each cell 12 is contemplated within the scope of the disclosed embodiments.

Referring now to FIGS. 7*a*-7*f*, an exemplary cell 12 of the surface support structure 10 of FIG. 3 is illustrated. The cell 12 is illustrated with four upright walls as one non-limiting example of a cell 12. It should be understood that any combination of upright walls 14, 15 of any cell 12 of FIG. 3 could be utilized and the upright walls 14 are for illustrative purposes. Of course, any suitable amount of upright walls 14 is contemplated within the scope of the disclosed embodiments.

Figure 7A:
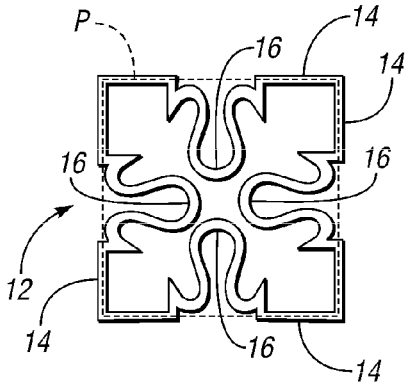
FIG. 7*a* is a plan view of a cell of the surface support structure of FIG. 3.

In FIG. 7*a*, the cell 12 is illustrated under normal at rest conditions such that the cell 12 is not extended or contracted. Under normal conditions, the cell 12 has a perimeter P defined by the upright walls 14. In the illustrated embodiment, the recessed portions 16 formed in each upright wall 14 do not extend beyond the perimeter P of the cell 12. Although the recessed portions 16 are illustrated in each upright wall 14, the recessed portions 16 may be formed in only one or more of the upright walls 14, as desired.

Since the recessed portions 16 are contained within the perimeter P of the cell 12, each cell 12 can be integrally formed with another cell 12 without interference between adjacent recessed portions 16, as illustrated in FIG. 3. In at least one embodiment, the recessed portions 16 are orientated within corners of the upright walls 14 and extend within the perimeter P of the cell 12. Of course, any suitable orientation for the recessed portions 16 is contemplated within the scope of the disclosed embodiments.

Figure 7B:
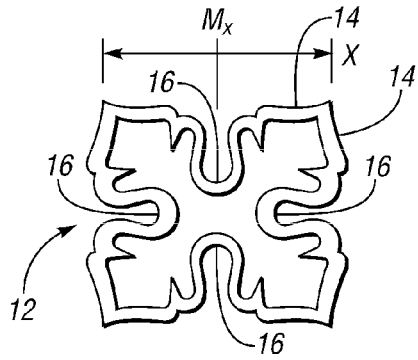
FIG. 7*b* is a plan view of a cell of FIG. 7*a* illustrating extension of the cell.
Figure 7C:
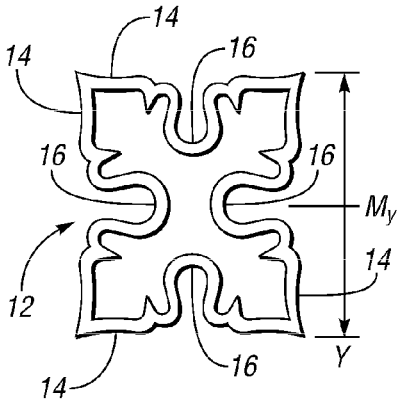
FIG. 7*c* is a view similar to that of FIG. 7*b* illustrating another extension of the cell.

In FIGS. 7*b* and 7*c*, the cell 12 illustrated in FIG. 7*a* is illustrated in two extended positions. In FIG. 7*b*, the cell 12 is extended along the x-axis X, and in FIG. 7*c*, the cell 12 is extended along the y-axis Y. In FIG. 7*b*, the cell 12 is extended outward from a midpoint $M_x$ along the x-axis X. In FIG. 7*c*, the cell 12 is extended outward from a midpoint $M_y$ along the y-axis Y. Of course, the cell 12 can be extended along the x-axis X and the y-axis Y simultaneously and as discuss below, the cell 12 may also move about the z-axis.

Figure 7D:
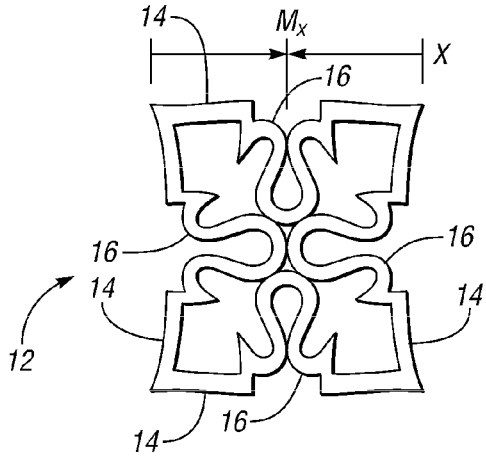
FIG. 7*d* is a plan view of a cell of FIG. 7*a* illustrating compression of the cell.
Figure 7E:
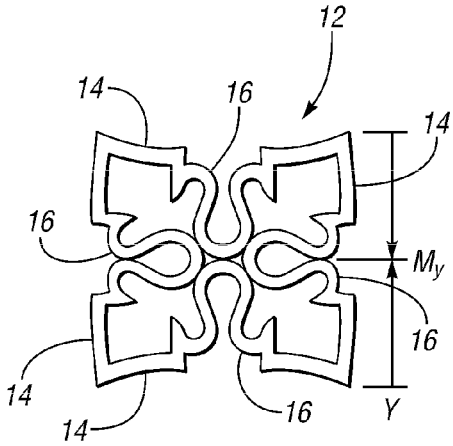
FIG. 7*e* is a view similar to that of FIG. 7*d* illustrating another extension of the cell.

In FIGS. 7*d* and 7*e*, the cell 12 of FIG. 7*a* is illustrated in two contracted positions. In FIG. 7*d*, the cell 12 is contracted along the x-axis X, and in FIG. 7*e*, the cell 12 is contracted along the y-axis Y. In FIG. 7*d*, the cell 12 is contracted outward from a midpoint $M_x$ along the x-axis X. In FIG. 7*e*, the cell 12 is contracted outward from a midpoint $M_y$ along the y-axis Y. Of course, the cell 12 can be contracted and/or extended along the x-axis X and the y-axis Y simultaneously and as discuss below, the cell 12 may also move about the z-axis.

Figure 7F:
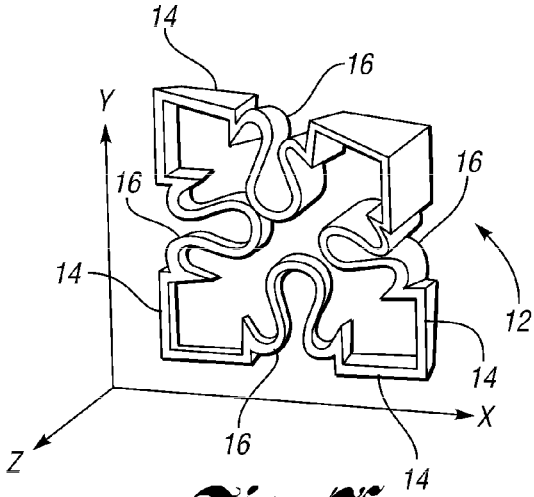
FIG. 7*f* is a plan view of a cell of FIG. 7*a* illustrating another extension of the cell.

Referring now to FIG. 7*f*, the cell 12 shown in FIG. 7*a* is depicted in an extended or rotated position. The cell 12 is rotated along the z-axis Z to illustrate that the cell 12 can adjust to various ground surfaces and various ground topography. The cell 12 can be rotated about the z-axis Z in a direction opposite to the direction illustrated. Additionally, one portion of the cell 12 may move about the z-axis in one direction while another portion of the cell 12 moves about the z-axis in another direction. In at least one embodiment, the cell 12 is extended along the x-axis X and rotated in along the z-axis Z. In another embodiment, the cell 12 is contracted along the x-axis X and rotated in along the z-axis Z. In still another embodiment, the cell 12 is extended along the y-axis Y and rotated in along the z-axis Z. In yet another embodiment, the cell 12 is contracted along the y-axis Y and rotated in along the z-axis Z. The recessed portions 16 allow the cell 12 to move/rotate about the z-axis Z in order for a local portion of the cell 12 to move. Since the cell 12 can have localized movement, the surface support structure 10 of FIGS. 1-6, can also have localized movement within various portions of various cells 12 with expansion and/or contraction about x-axis X, the y-axis Y, and/or the z-axis Z and differing cells 12 having differing expansion and/or contraction.

Figure 8:
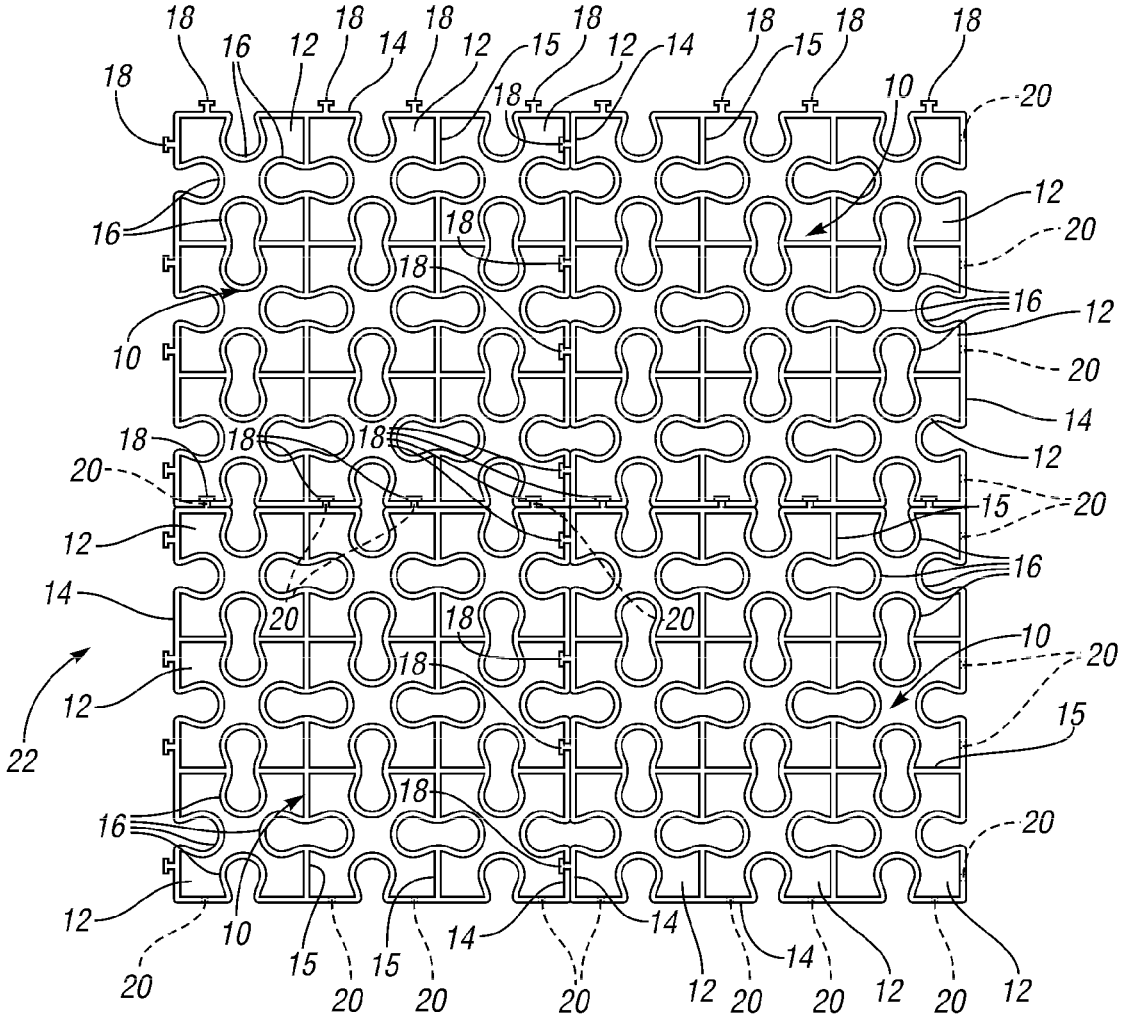
FIG. 8 is a plan view of an embodiment of a surface support assembly.

With reference now to FIG. 8, a surface support structure assembly 22 is illustrated having multiple surface support structures 10 that are joined together with fasteners 18. The fasteners 18 can be provided on outer upright walls 14 of the surface support structures 10 to join one surface support structure 10 to another surface support structure 10. As illustrated, one surface support structure 10 may be joined to multiple other surface support structures 10 so that the surface support structure assembly 22 can be built to accommodate various size requirements of various ground surfaces.

In at least one embodiment, the surface support structures 10 are formed with apertures 20 provided within outer upright walls 14. The apertures 20 are orientated to receive the fasteners 18 provided on adjacently provided surface support structures 10. The fasteners 18 can be inserted into the apertures 20 and retained within the apertures 20 to form the surface support structure assembly 22. Any suitable amount of fasteners 18 and/or apertures 20 is contemplated within the scope of the disclosed embodiments.

As illustrated, when surface support structures 10 are joined together, recessed portions 16 allow movement of each cell 12 even proximate outer upright walls 14. Thus, the surface support structure assembly 22 has continuous flexibility that is not discontinued between the surface support structures 10 where joined together.

The surface support structures 10 each have recessed portions 16 provided in each cell 12 to allow local movement within each cell 12. The local movement of each cell 12 can be along any of the x-axis, y-axis and the z-axis, as discussed above. The local movement of each cell 12 allows the surface support structure assembly 22 to be easily installed on various ground surfaces and can adapt to various ground topographies that may change over time.

Figure 9:
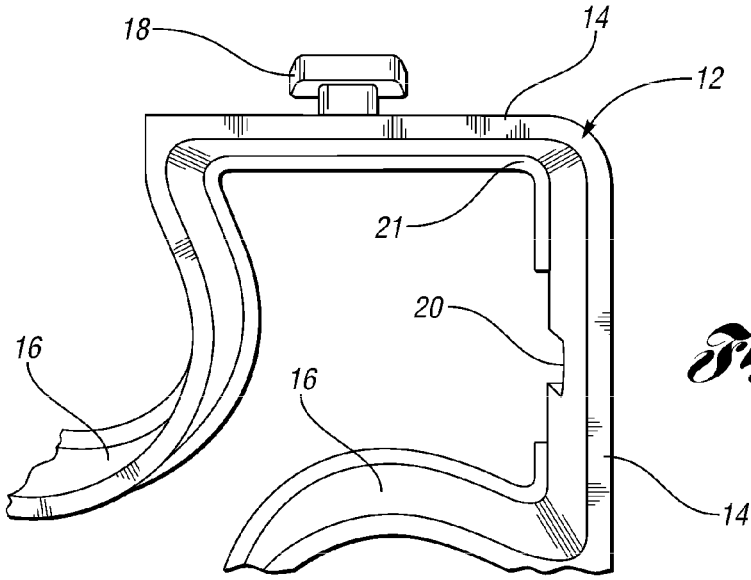
FIG. 9 is an enlarged plan view of a portion of a cell of the surface support structure of FIG. 1.
Figure 10:
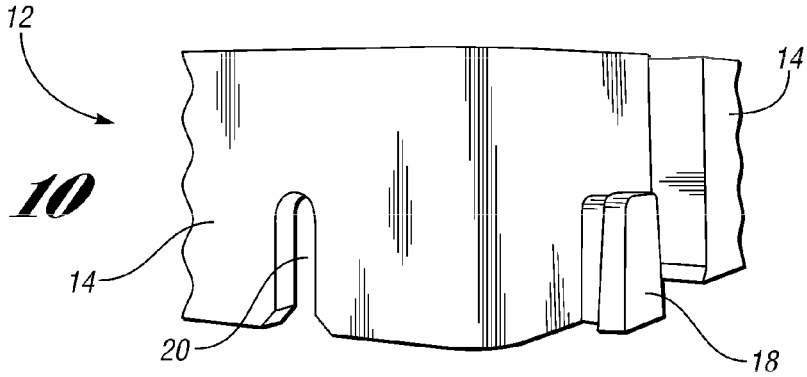
FIG. 10 is a side perspective view of the portion of the cell of FIG. 9.
Figure 11:
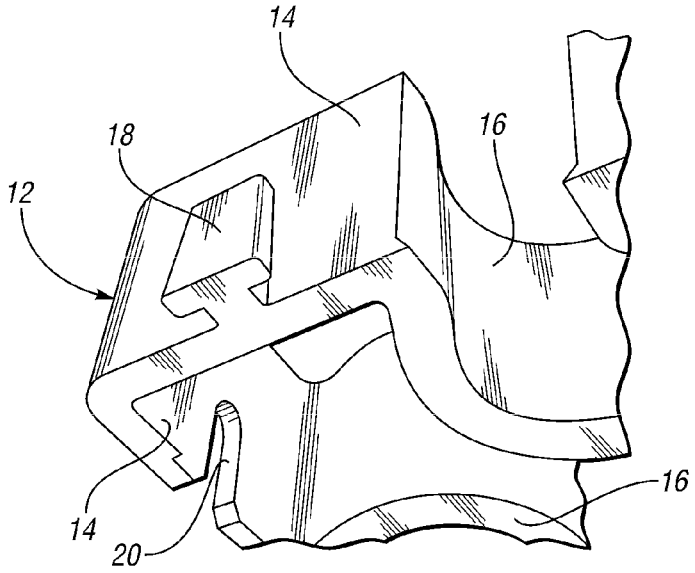
FIG. 11 is a bottom perspective view of the portion of the cell of FIG. 9.

Referring now to FIGS. 9-11, an embodiment of a fastener 18 is illustrated on an upright wall 14 of a cell. An aperture 20 is provided on another upright wall 14 of the cell 12 and is sized to receive a fastener 18 from another cell 12. As illustrated, the fastener 18 may be tapered so that engagement between the fastener 18 and an aperture 20 is increased. When multiple fasteners 18 are inserted into coordinating apertures 20, as depicted in FIG. 8, firm connections are established between surface support structures 10 so that movement is minimal between the fasteners 18 and the cells 12 move the majority through the recessed portions 16.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed:

1. A surface support structure comprising:

at least one cell having a plurality of integral upright walls, a first of the plurality of upright walls having generally coplanar spaced face portions and an inwardly extending recessed portion to allow extension and contraction in multiple directions of the at least one cell, the recessed portion extending continuously and unintersected between and connecting the spaced face portions such that a void is present between the spaced face portions;

wherein the plurality of upright walls of the at least one cell defines a perimeter such that the recessed portion extends towards a second wall of the plurality of upright walls and is within the perimeter;

wherein the at least one cell further comprises:

a first cell having a plurality of upright walls, each of the plurality of upright walls having a recessed portion to allow extension and contraction in multiple directions of the first cell; and a second cell having a plurality of upright walls, each of the upright walls having a recessed portion to allow extension and contraction in multiple directions of the second cell;

wherein at least one of the plurality of upright walls of the first cell forms at least one of the plurality of upright walls of the second cell such that the recessed portion formed in the at least one of the plurality of upright walls of the first cell extends in a direction opposite to the recessed portion formed in the at least one of the plurality of upright walls of the second cell.

2. The surface support structure of claim 1 further comprising a third cell having a plurality of upright walls, each of the upright walls having a recessed portion to allow extension and contraction in multiple directions of the third cell;

wherein at least one of the plurality of upright walls of the second cell forms at least one of the plurality of upright walls of the third cell such that the recessed portion formed in the at least one of the plurality of upright walls of the second cell extends in a direction opposite to the recessed portion formed in the at least one of the plurality of upright walls of the third cell.

3. The surface support structure of claim 2 wherein the first cell further comprises at least one fastener provided on at least one of the upright walls; and wherein at least one of the upright walls of the third cell defines at least one aperture provided therein sized to receive the at least one fastener provided on the first cell.

4. The surface support structure of claim 1 wherein the recessed portion further comprises:

a first recessed portion extending towards the second wall; and a second recessed portion formed in the upright second wall of the cell such that the second recessed portion extends in a direction opposite to the first recessed portion.

5. The surface support structure of claim 1 wherein the recessed portion of each of the plurality of upright walls further comprises an arcuate recessed portion.

6. The surface support structure of claim 5 wherein the arcuate recessed portion of each of the plurality of upright walls further comprises an omega-shaped recessed portion.

7. The surface support structure of claim 1 wherein the cell further comprises a protruding edge provided proximate a lower edge of the cell.

8. The surface support structure of claim 1 wherein the at least one cell further comprises four integrally formed upright walls.

9. The surface support structure of claim 1 wherein the at least one cell further comprises at least one fastener provided on at least one of the upright walls.

10. The surface support structure of claim 1 wherein at least one of the upright walls of the at least one cell defines at least one aperture provided therein sized to receive at least one fastener.

11. The surface support structure of claim 1 wherein no wall extends coplanarly between the spaced face portions.

12. The surface support structure of claim 11 wherein the recessed portion enables the spaced face portions to move toward each other.

* * * * *